US007153220B2

(12) United States Patent
Lo

(10) Patent No.: US 7,153,220 B2
(45) Date of Patent: Dec. 26, 2006

(54) GOLF CLUB HEAD WITH ADJUSTABLE WEIGHT MEMBER

(75) Inventor: Lai-Fa Lo, Taoyuan (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 214 days.

(21) Appl. No.: 10/988,526

(22) Filed: Nov. 16, 2004

(65) Prior Publication Data

US 2006/0105856 A1 May 18, 2006

(51) Int. Cl.
*A63B 53/06* (2006.01)

(52) U.S. Cl. ..... 473/335; 473/338; 473/340

(58) Field of Classification Search ..... 473/324–350
See application file for complete search history.

(56) References Cited

U.S. PATENT DOCUMENTS 1,213,382 A * 1/1917 Kent ..... 473/338
4,043,563 A * 8/1977 Churchward ..... 473/338
4,085,934 A * 4/1978 Churchward ..... 473/338
4,867,458 A * 9/1989 Sumikawa et al. ..... 473/336
5,050,879 A 9/1991 Sun et al.
6,089,994 A * 7/2000 Sun ..... 473/338
6,146,287 A * 11/2000 Rugge et al. ..... 473/334
6,290,607 B1 9/2001 Gilbert et al.
6,409,612 B1 * 6/2002 Evans et al. ..... 473/324
2002/0137576 A1 9/2002 Dammen
2003/0148818 A1 8/2003 Myrhum et al.

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP

(57) ABSTRACT

A golf club head includes a body having at least one recessed portion for securely receiving at least one weight member. The weight member includes a lid with a plurality of protrusions respectively received in receiving portions of the recessed portion. At least one of the protrusions has a weight different from those of other protrusions. The lid has a symmetric shape the same as that of the recessed portion of the body, allowing the lid to be mounted in the recessed portion in one of at least two orientations that correspond to at least two different locations of a center of gravity of the golf club head, thereby allowing rapid change in the center of the gravity of the golf club head.

10 Claims, 9 Drawing Sheets

GOLF CLUB HEAD WITH ADJUSTABLE WEIGHT MEMBER

BACKGROUND OF THE INVENTION

1. Field of the Invention

The present invention relates to a golf club head. In particular, the present invention relates to a golf club head with at least one adjustable weight member.

2. Description of Related Art

U.S. Publication No. US2002/0137576 A1 discloses a golf club head with adjustable weights. The golf club head is provided with at least one movable screw or weight for adjustment of the club heads balance. The screw is mounted in a tube sleeve inside the club head. The length of the screw is shorter than the length of the tubular sleeve. The screw is threadedly engaged in the tubular sleeve and may be positioned in the desired position. A lid is fastened to the opening of the tubular sleeve, which prevents grass and earth from penetrating into the tubular sleeve.

In adjustment, the user has to use a tool to adjust the screw(s) and the lid(s) one by one, which is time-consuming and laborsome. Further, the adjusting ranges of the screw(s) and the lid(s) are relatively large and thus difficult to control. Further, it is difficult to control the location of the center of gravity of the golf club head.

OBJECTS OF THE INVENTION

An object of the present invention is to provide a golf club head that allows more flexible adjustment in the center of gravity.

Another object of the present invention is to provide a golf club head that allows easy, rapid adjustment in the center of gravity.

SUMMARY OF THE INVENTION

In accordance with an aspect of the present invention, a golf club head comprises a body, at least one weight member, and at least one engaging member. The body includes at least one recessed portion that includes a plurality of receiving portions and at least one engaging portion. The at least one weight member is mounted in the at least one recessed portion. The at least one weight member includes a lid, a plurality of protrusions on the lid, and at least one engaging portion on the lid.

At least one of the plurality of protrusions has a weight different from those of other protrusions. The lid has a symmetric shape the same as that of the at least one recessed portion of the body, allowing the lid to be mounted in the at least one recessed portion in one of at least two orientations with respect to the at least one recessed portion that correspond to at least two different locations of a center of gravity of the golf club head, with the plurality of protrusions being respectively received in the plurality of receiving portions, thereby allowing rapid change in the center of the gravity of the golf club head. The at least one engaging member engages with the at least one engaging portion of the at least one recessed portion and the at least one engaging portion of the at least one weight member. The at least one weight member is thus fixed in the at least one recessed portion.

By such an arrangement, at least two options for a center of gravity of the golf club head in accordance with the present invention are provided, and the location of the center of gravity can be changed through simple, rapid operation.

Each of the at least one recessed portion of the body and the lid of the at least one weight member is symmetric in shape and is a square, rhombus, parallelogram, rectangle, polygon, circle, ellipse, triangle, or star polygon in section.

At least two of the plurality of protrusions on the lid have an identical weight. In an embodiment of the invention, the weights of the plurality of protrusions on the lid are different from one another.

In an embodiment of the invention, the at least one engaging portion of the body and the at least one engaging portion of the weight member are screw holes, and the at least one engaging member is a bolt.

In an embodiment of the invention, the body includes two diametrically disposed engaging portions on two diametrically disposed receiving portions of said at least one recessed portion, and the at least one weighting member includes two diametrically disposed engaging portions on an inner face of the lid.

In another embodiment of the invention, the at least one recessed portion includes a single engaging portion in a center of a bottom wall thereof, and the lid includes a single engaging portion on an inner face thereof.

The at least one recessed portion of the body may be adjacent to a rear of a sole, a toe of the sole, a heel of the sole, a center of the sole, or a striking face of the body.

In another embodiment of the invention, the at least one recessed portion of the body is provided on at least one of a plurality of skirts of the body and adjacent to a rear, a toe, and a heel of the body.

The body may be of wooden type, iron type, or putter type.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
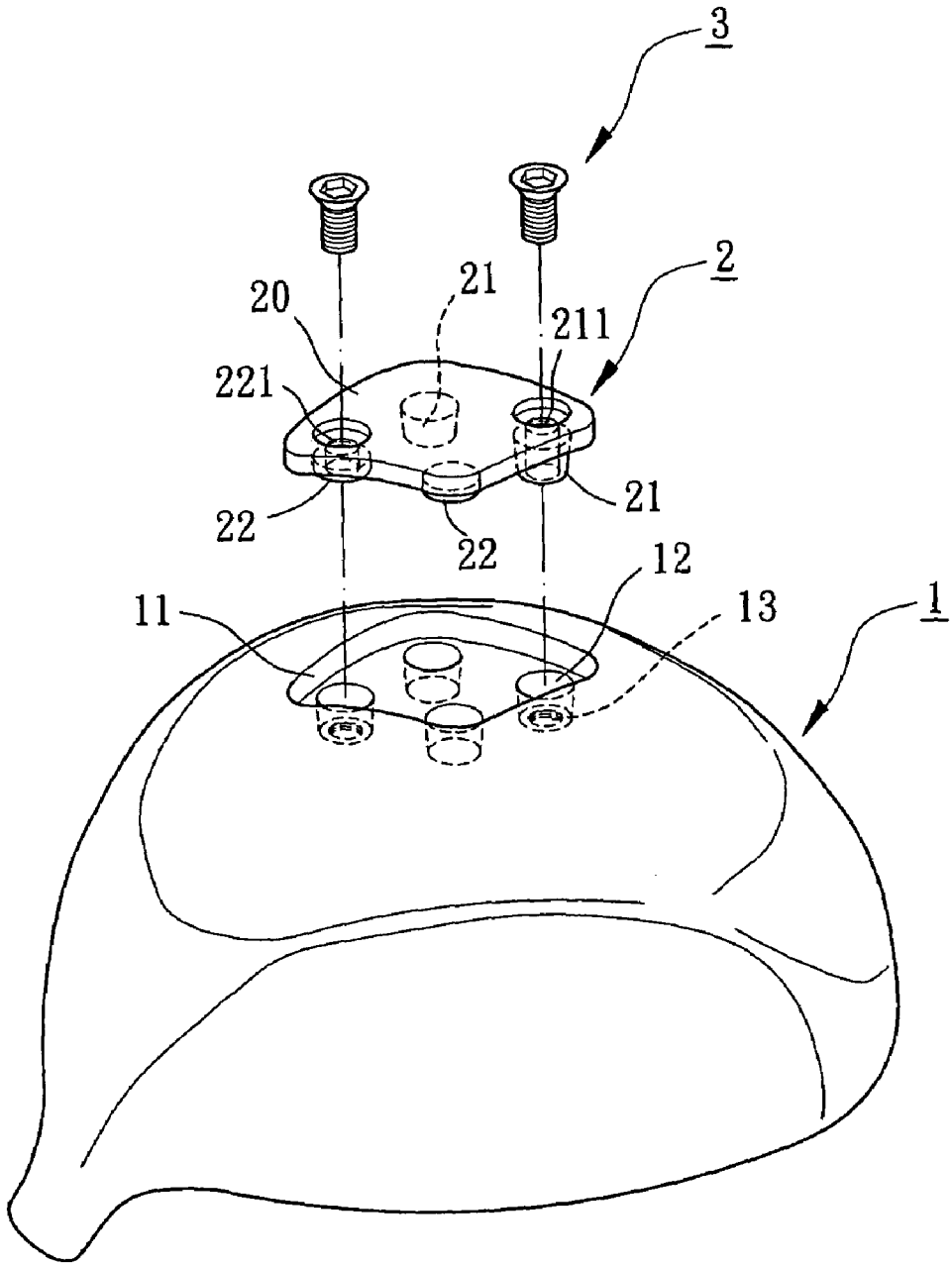
FIG. 1 is an exploded perspective view of an embodiment of a golf club head in accordance with the present invention.

Referring to FIG. 1, an embodiment of a golf club head in accordance with the present invention comprises a body 1, a weight member 2, and two engaging members 3. The body 1 is of wooden type, iron type, or putter type. In the illustrated embodiment, the body 1 is a wooden type body the detailed structure of which is not described to avoid redundancy.

The body 1 comprises a recessed portion 11 in, e.g., a rear of a sole thereof. Preferably, the recessed portion 11 has a symmetric geometric shape, such as a square, rhombus, or parallelogram in section. A bottom wall of the recessed portion 11 includes a plurality of receiving portions 12 (four in this embodiment) and two engaging portions 13. The receiving portions 12 are symmetrically arranged in four corners of the bottom wall of the recessed portion 11 and have an identical volume. The engaging portions 13 are arranged in two of the receiving portions 12 that are diametrically disposed. Preferably, each engaging portion 13 is a screw hole defined in a bottom wall of the associated receiving portion 12 or any other equivalent structure.

Figure 2:
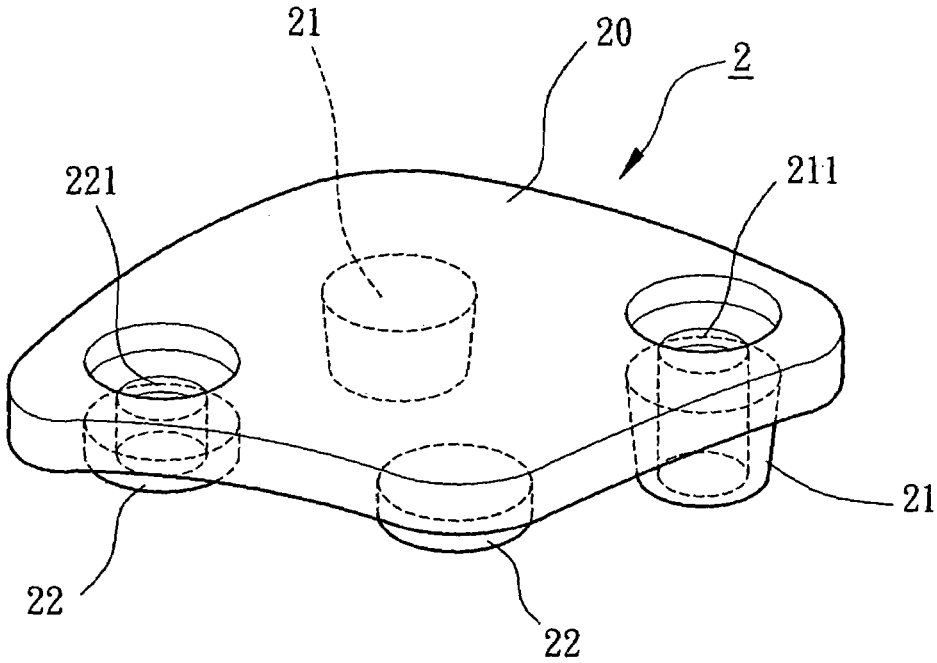
FIG. 2 is a perspective view of a weight member of the golf club head in FIG. 1.

The weight member 2 is preferably made of a material having a specific gravity different from that of the body 1. Referring to FIGS. 1 and 2, the weight member 2 comprises a lid 20, two first protrusions 21, and two second protrusions 22. The lid 20 has a shape the same as that of the recessed portion 11, such as a square, rhombus, or parallelogram in section. The protrusions 21 and 22 are formed on four corners of an inner face of the lid 20, with the first protrusions 21 being spaced from each other by 90 degrees and having the same weight, and with the second protrusions 22 being spaced from each other by 90 degrees and having the same weight. One of the first protrusions 21 includes an engaging portion 211 that is preferably a screw hole extending from an outer face of the lid 20 through the associated first protrusion 21 or any other equivalent structure. One of the second protrusions 22 includes an engaging portion 221 that is preferably a screw hole extending from the outer face of the lid 20 through the associated second protrusion 22 or any other equivalent structure. The weight of each first protrusion 21 is different from that of each second protrusion 22. Preferably, each engaging member 3 is a bolt or any other equivalent structure.

Figure 3:
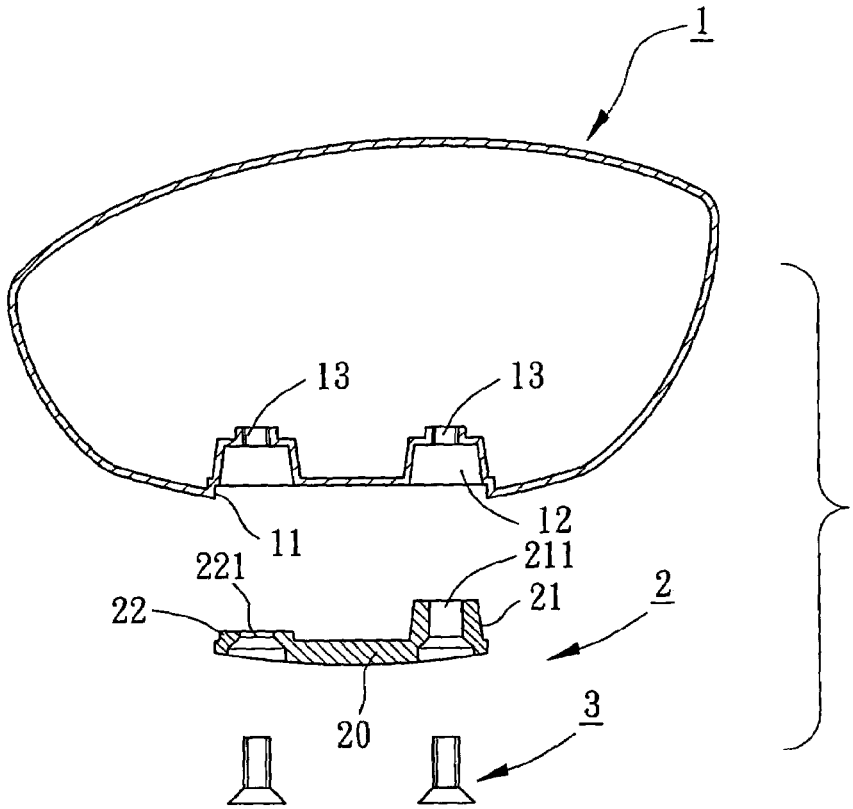
FIG. 3 is an exploded sectional view of the golf club head in FIG. 1.
Figure 4:
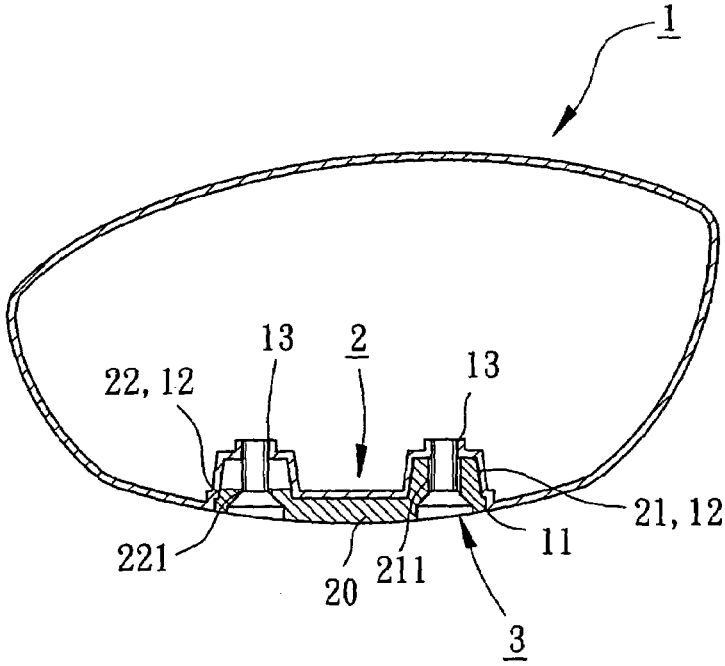
FIG. 4 is a sectional view of the golf club head in FIG. 1.

Referring to FIGS. 3 and 4, in assembly, the lid 2 is mounted into the recessed portion 11 of the body 1, with the engaging portions 211 and 221 of the lid 2 being aligned with the engaging portions 13 of the recessed portion 11. Next, the engaging members 3 are extended through the engaging portions 211 and 221 of the lid 20 into the engaging portions 13 of the recessed portion 11. Thus, the weight member 2 is fixed in the recessed portion 11. After assembly, the protrusions 21 and the second protrusions 22 are located at different positions of the body 1, thereby adjusting the center of gravity to a desired location (not shown).

Figure 5:
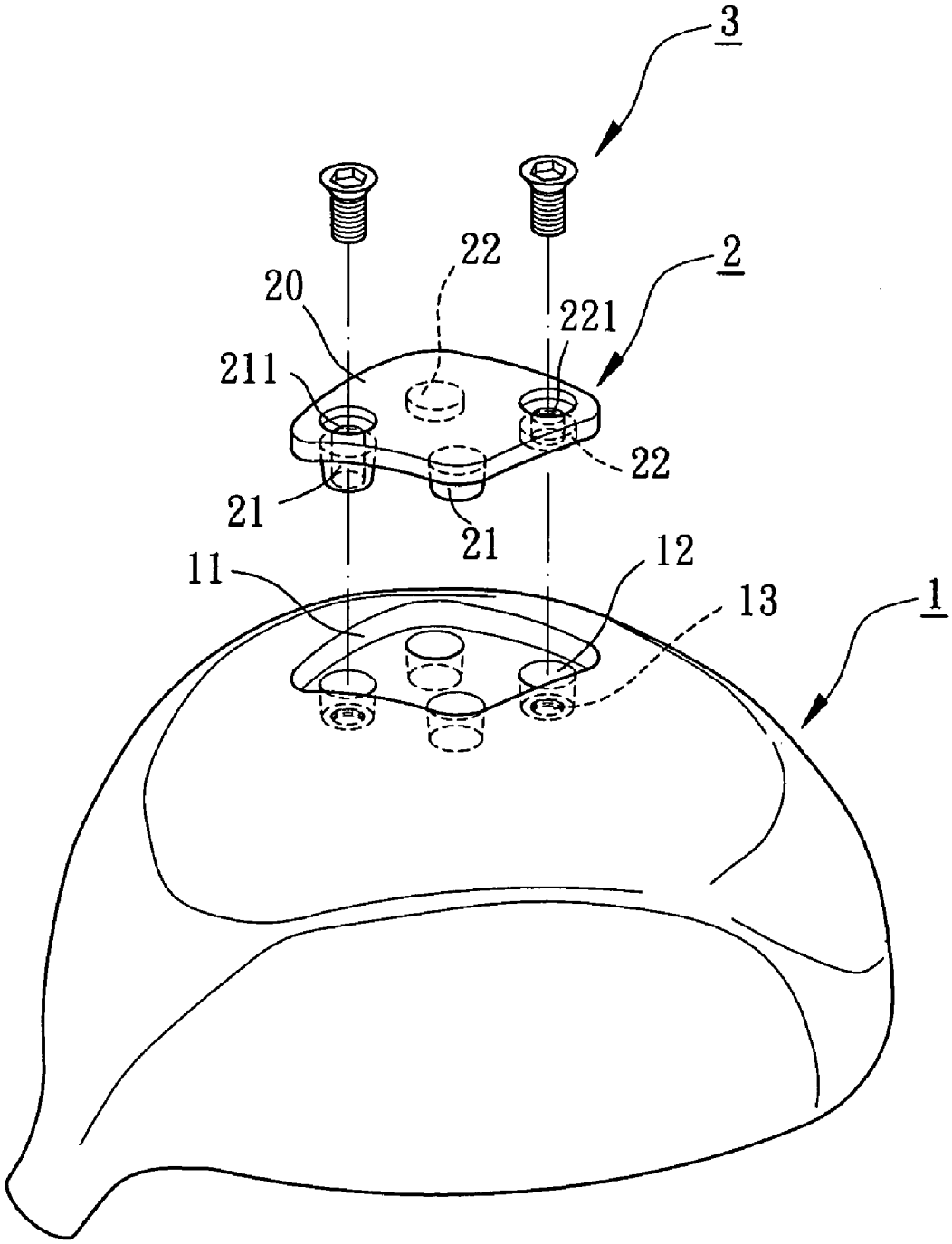
FIG. 5 is an exploded perspective view similar to FIG. 1, wherein the weight member of the golf club head is in a different orientation.

Since the lid 20 and the protrusions 21 and 22 of the weight member 2 are symmetrically arranged, the lid 20 can still be engaged with the recessed portion 11 after the lid 20 has been rotated through 180 degrees, as illustrated in FIG. 5. Thus, the positions of the first protrusions 21 and the second protrusions 22 are switched with each other, shifting the center of the gravity of the golf club head to another location (not shown). Thus, the weight member 2 provides at least two different weighting effects by means of changing the orientation of the weight member 2, which is a simple operation. More flexible adjustment in the center of gravity is allowed while providing rapid, convenient adjustment.

Figure 6:
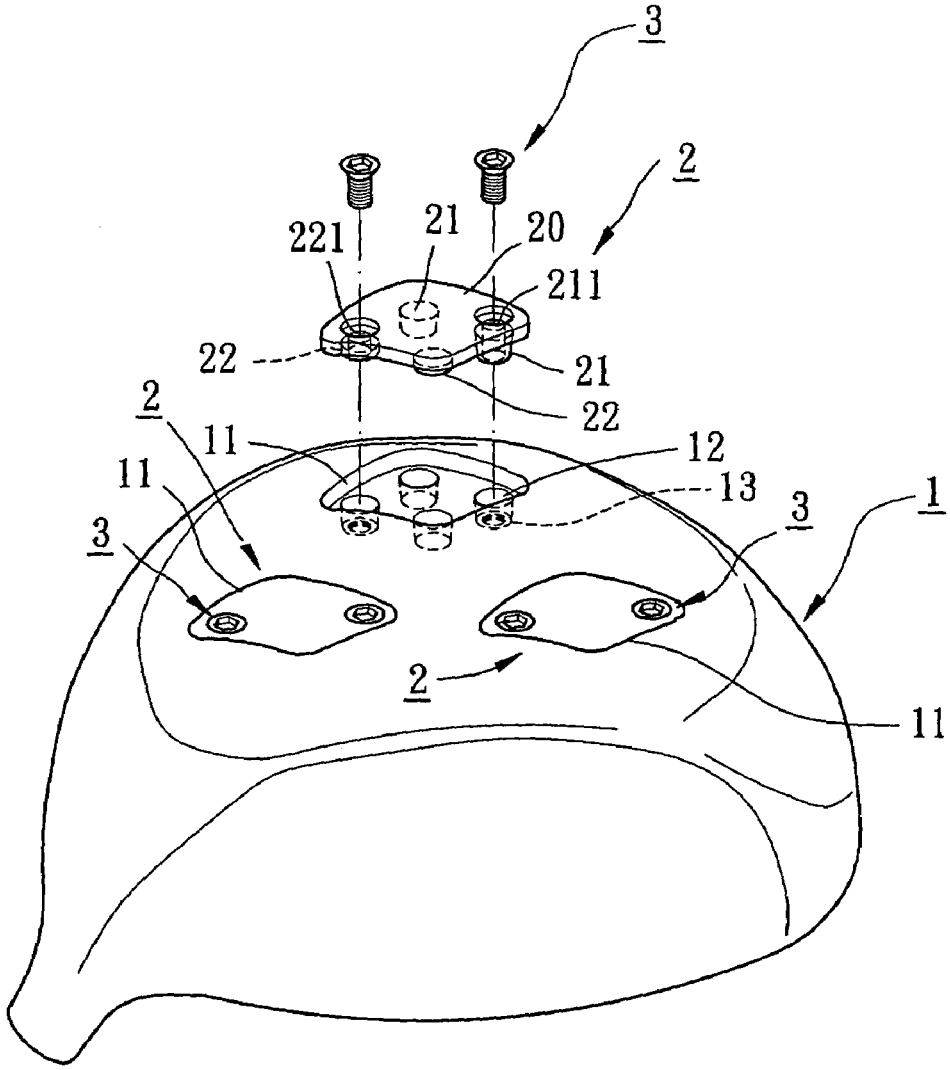
FIG. 6 is an exploded perspective view of a modified embodiment of the golf club head in accordance with the present invention.
Figure 6A:
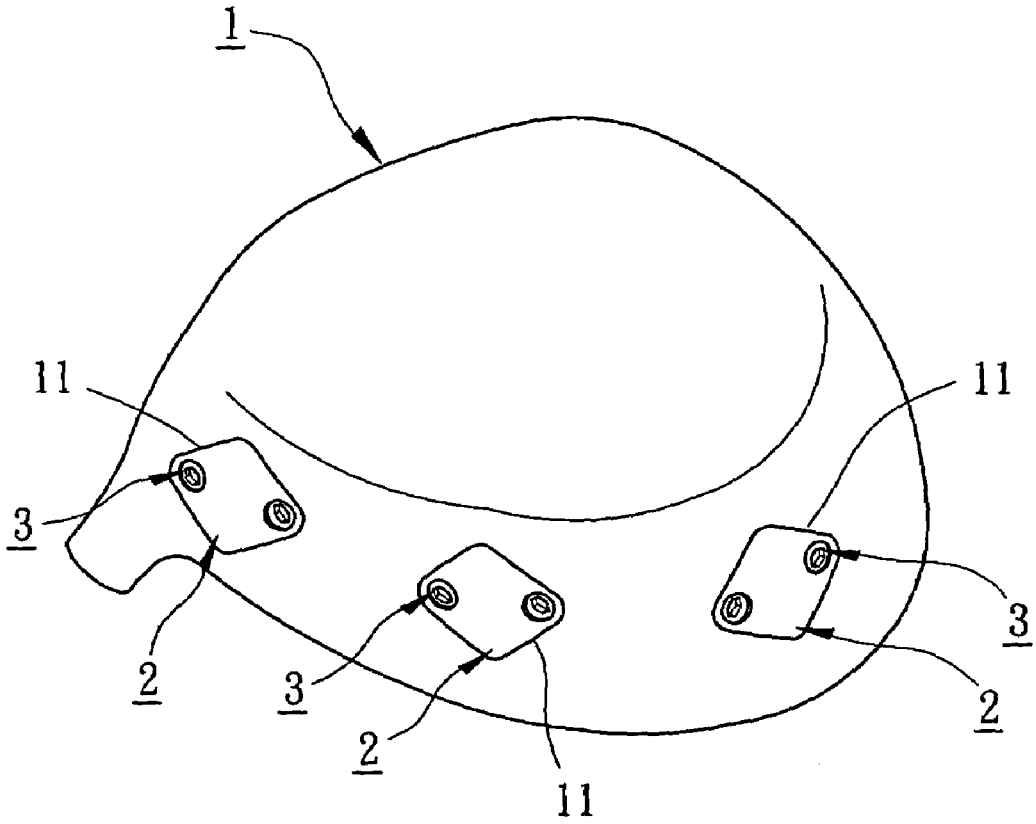
FIG. 6A is a perspective view of another modified embodiment of the golf club head in accordance with the present invention.

FIGS. 6 and 6A show modified embodiments of the golf club head in accordance with the present invention. A plurality of recessed portions 11 are provided in the sole or other portions of the body 1. Further, a corresponding number of weight members 2 and engaging members 3 are provided. In the embodiment shown in FIG. 6, the recessed portions 11 are in the sole of the body 1 and respectively adjacent to the rear, toe, and heel of the sole of the body 1. Alternatively, the recessed portions 11 can be provided on the striking face of the body 1. In the embodiment shown in FIG. 6A, the recessed portions 11 are provided on the skirts of the body 1 and respectively adjacent to the rear, toe, and heel of the body 1. Since each of the three weight members 2 provides two options for the location of the center of gravity, there are eight options in total for the location of the center of gravity of the golf club head. More flexible, rapid adjustment in response to various needs in the design of center of gravity of various products is allowed.

Figure 7:
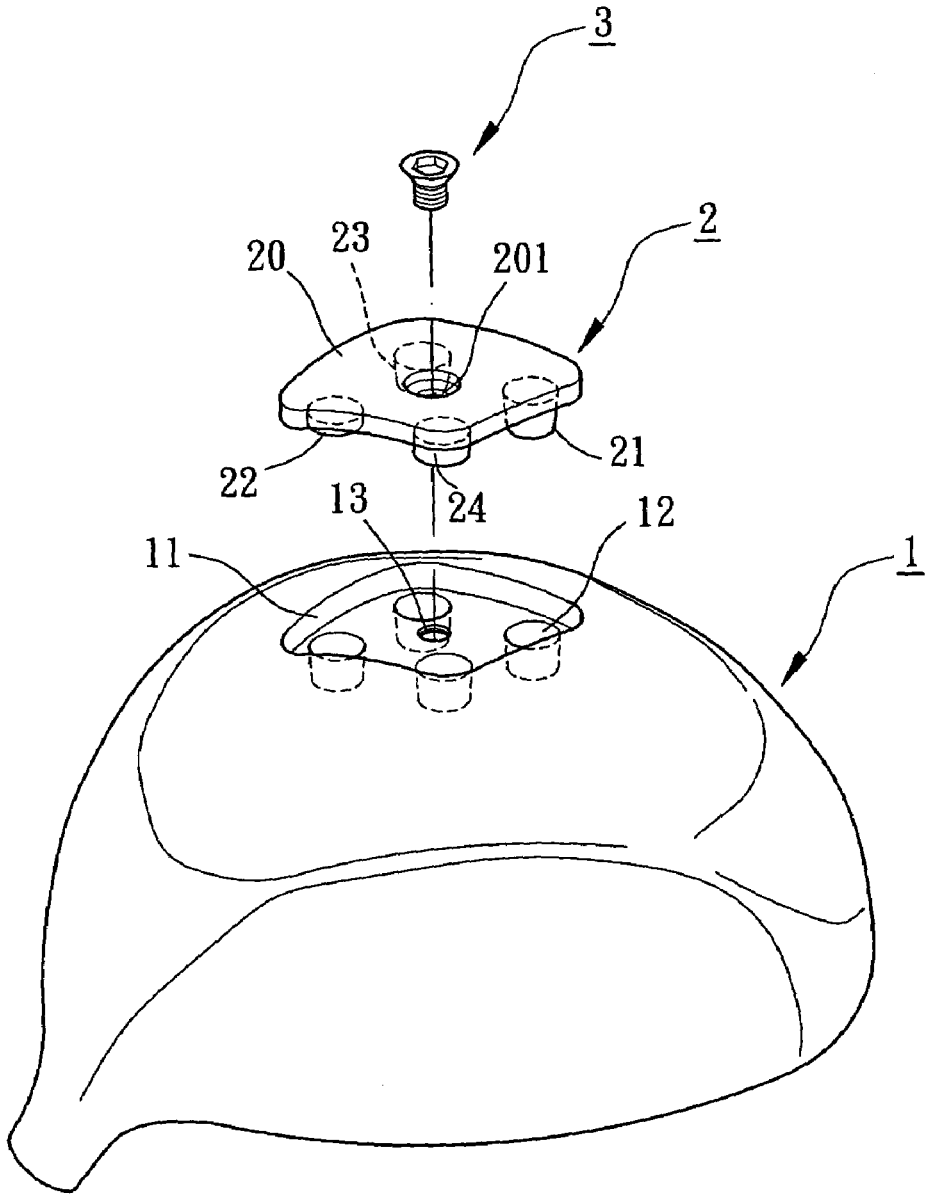
FIG. 7 is a perspective view of still a further modified embodiment of the golf club head in accordance with the present invention.
Figure 8:
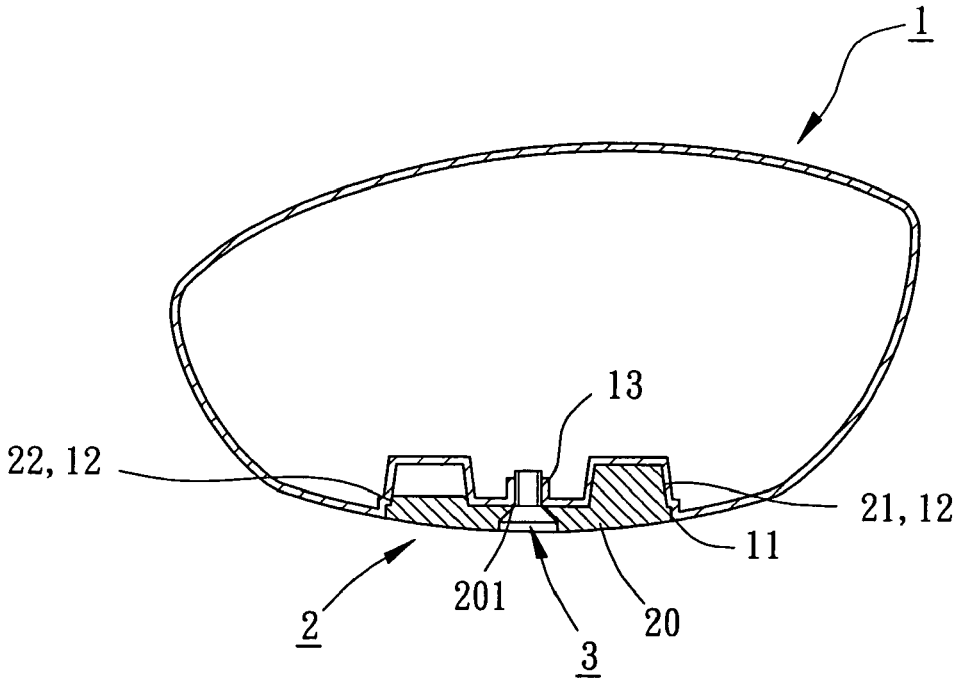
FIG. 8 is a sectional view of the golf club head in FIG. 7.

FIGS. 7 and 8 show a further modified embodiment of the golf club head in accordance with the present invention. In this embodiment, the weight member 2 includes a lid 20 and four different protrusions 21, 22, 23, and 24 having different weights. Further, an engaging portion 201 is provided in a center of the lid 20. Four receiving portions 12 are symmetrically defined in the bottom wall of the recessed portion 11 of the body 1 and have an identical volume. Further, an engaging portion 13 is provided in a center of the bottom wall of the recessed portion 13. In assembly, the lid 20 is fixed in the recessed portion 11 by a single engaging member 3 that extends through the engaging portion 201 of the lid 20 and the engaging portion 13 of the recessed portion 11. The lid 20 and the recessed portion 11 are not circular and have the same shape (such as a square, rhombus, or parallelogram in section) to allow and maintain secure engagement between the lid 20 and the recessed portion 11. The lid 20 can be placed in one of four orientations with respect to the recessed portion 11 and thus provides four options for the center of gravity of the golf club head, as the weights of the four protrusions 21, 22, 23, and 24 are different from one another.

Figure 9:
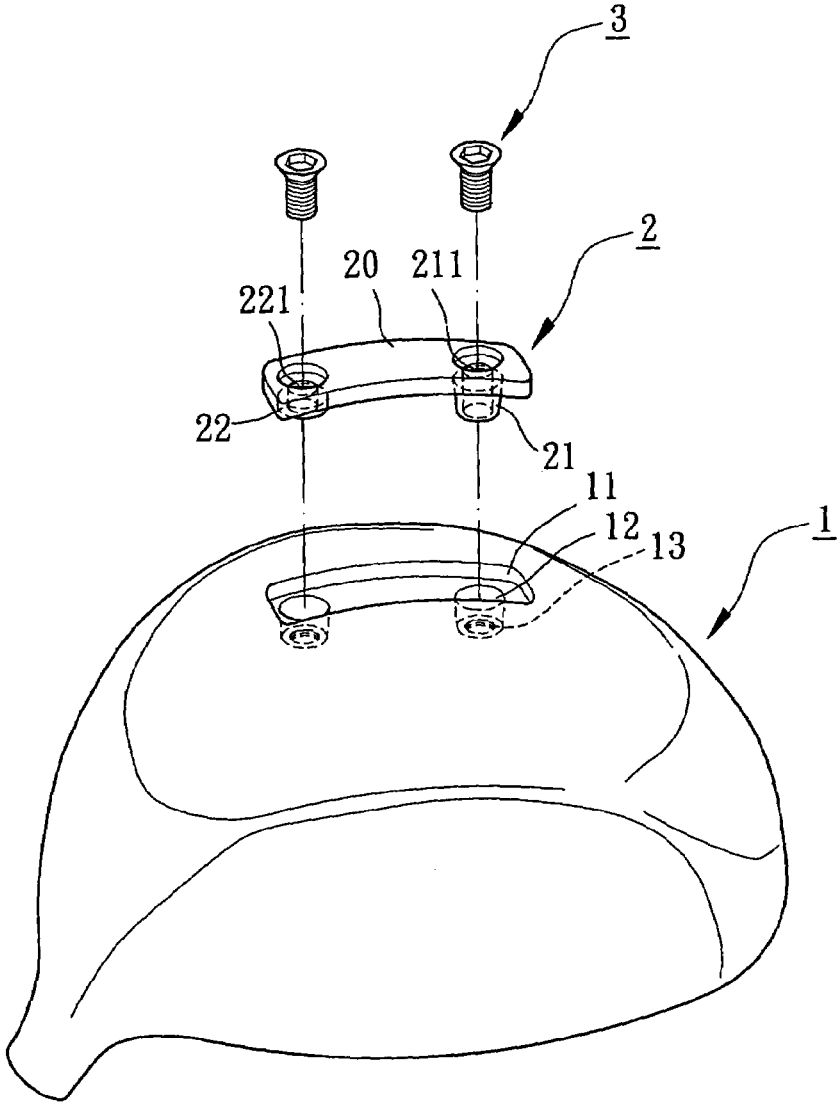
FIG. 9 is an exploded perspective view of still another modified embodiment of the golf club head in accordance with the present invention.

FIG. 9 shows still another modified embodiment of the golf club head in accordance with the present invention. In this embodiment, the recessed portion 11 and the lid 20 of the weight member 2 have a different geometric shape, such as rectangular. A first protrusion 21 and a second protrusion 22 are formed on an inner face of the lid 20. An engaging portion 211 is formed in the first protrusion 21 and an engaging portion 221 is formed in the second protrusion 22. By such an arrangement, the weight member 2 provides two options for the center of gravity of the golf club head, as the lid 2 can still be mounted in the recessed portion 11 after it is turned through 180 degrees. Two different weight adjusting effects are thus provided.

The shape of the lid 20 may be varied according to product needs, such as a polygon, circle, ellipse, triangle, or star polygon in section, providing at least two weight adjusting effects by a single weight member 2 through rapid operation.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A gold club head comprising:

a body comprising at least one recessed portion, said at least one recessed portion including a plurality of receiving portions and at least one engaging portion;

at least one weight member mounted in said at least one recessed portion, said at least one weight member including a lid, a plurality of protrusions on the lid, and at least one engaging portion on the lid, at least one of the plurality of protrusions having a weight different from those of other protrusions, the lid having a symmetric shape the same as that of said at least one recessed portion of the body, allowing the lid to be mounted in said at least one recessed portion in one of at least two orientations with respect to said at least one recessed portion that correspond to at least two different locations of a center of gravity of the golf club head, with the plurality of protrusions being respectively received in the plurality of receiving portions, thereby allowing rapid change in a center of the gravity of the golf club head; and at least one engaging member for engaging with said at least one engaging portion of said at least one recessed portion and said at least one engaging portion of said at least one weight member.

2. The golf club head as claimed in claim 1 wherein each of said at least one recessed portion of the body and the lid of said at least one weight member is symmetric in shape and is one of a square, rhombus, parallelogram, rectangle, polygon, circle, ellipse, triangle, and star polygon in section.

3. The golf club head as claimed in claim 1 wherein at least two of the plurality of protrusions on the lid have an identical weight.

4. The golf club head as claimed in claim 1 wherein the weights of the plurality of protrusions on the lid are different from one another.

5. The golf club head as claimed in claim 1 wherein said at least one engaging portion of the body and said at least one engaging portion of the weight member are screw holes, and wherein said at least one engaging member is a bolt.

6. The golf club head as claimed in claim 1 wherein the body includes two diametrically disposed engaging portions on two diametrically disposed receiving portions of said at least one recessed portion, and wherein said at least one weighting member includes two diametrically disposed engaging portions on an inner face of the lid.

7. The golf club head as claimed in claim 1 wherein said at least one recessed portion includes a single engaging portion in a center of a bottom wall thereof, and wherein the lid includes a single engaging portion on an inner face thereof.

8. The golf club head as claimed in claim 1 wherein said at least one recessed portion of the body is adjacent to one of a rear of a sole, a toe of the sole, a heel of the sole, a center of the sole, and a striking face of the body.

9. The golf club head as claimed in claim 1 wherein said at least one recessed portion of the body is provided on at least one of a plurality of skirts of the body and adjacent to a rear, a toe, and a heel of the body.

10. The golf club head as claimed in claim 1 wherein the body is one of wooden type, iron type, and putter type.

* * * * *